US011107335B2

(12) United States Patent
Lamontagne et al.

(10) Patent No.: US 11,107,335 B2
(45) Date of Patent: Aug. 31, 2021

(54) ANTI-THEFT SYSTEM FOR STORES

(71) Applicant: The Swatch Group Research and Development Ltd, Marin (CH)

(72) Inventors: Alexandre Lamontagne, Cormondrèche (CH); Jonathan Bregnard, St-Aubin-Sauges (CH); Cédric Nicolas, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/925,605

(22) Filed: Jul. 10, 2020

(65) Prior Publication Data

US 2021/0065527 A1 Mar. 4, 2021

(30) Foreign Application Priority Data

Aug. 26, 2019 (EP) ..... 19193624

(51) Int. Cl.
*G08B 13/24* (2006.01)
*G08B 13/14* (2006.01)
*E05B 73/00* (2006.01)

(52) U.S. Cl.
CPC ..... *G08B 13/2434* (2013.01); *E05B 73/0017* (2013.01); *G08B 13/1427* (2013.01); *G08B 13/2431* (2013.01); *G08B 13/2462* (2013.01)

(58) Field of Classification Search
CPC ..... G08B 13/2434; G08B 13/2431; G08B 13/2462; G08B 13/1427; E05B 73/0017; G06F 21/88
USPC ..... 340/572.1
See application file for complete search history.

(56) References Cited

U.S. PATENT DOCUMENTS 5,151,684 A * 9/1992 Johnsen ..... G06K 19/07703 340/5.92
7,403,118 B2 * 7/2008 Belden, Jr. ..... E05B 45/005 340/568.2
8,717,165 B2 * 5/2014 Gernandt ..... G08B 21/0275 340/539.13
2015/0221194 A1 * 8/2015 Sarkar ..... G08B 13/2465 340/870.16
2019/0122519 A1 4/2019 Kazerouni

FOREIGN PATENT DOCUMENTS

GB 2505324 A 2/2014

OTHER PUBLICATIONS

European Search Report for EP 19 19 3624, dated Feb. 13, 2020.

* cited by examiner

*Primary Examiner* — John A Tweel, Jr.
(74) *Attorney, Agent, or Firm* — Sughrue Mion, PLLC

(57) ABSTRACT

An anti-theft system that can be applied in a commercial environment such as a watch store. The products on display in-store are secured by an electronic tag (4) attached to the product. The tag is provided with a chip (16) which emits a first signal which can only be received within a defined perimeter around the chip. An electronic transmitting device (5) is located within this perimeter, which sends the data transmitted within the first signal in the form of a second signal which further contains a value relative to the distance between the tag and the transmitting device. The second signal is managed by one or more computers, preferably of the portable type (6), which are equipped with a digital application configured to analyse the second signal to check for the presence of the tags (4) within a defined security zone (10) around the transmitting device (5).

10 Claims, 2 Drawing Sheets

ANTI-THEFT SYSTEM FOR STORES

CROSS REFERENCE TO RELATED APPLICATIONS

This application claims priority to European Patent Application No. 19193624.4 filed Aug. 26, 2019, the entire contents of which are incorporated herein by reference.

TECHNICAL FIELD OF THE INVENTION

The present invention relates to security systems applicable in luxury goods stores such as glasses or watch stores.

PRIOR ART

In order to protect the products on display in a store, systems are known using RFID (Radio Frequency Identification) chips attached to the products. These systems require the use of a bulky mechanical chip fastener, to be removed at the checkout during purchase using a special device or a pair of scissors, as well as the installation of a bulky infrastructure, in particular gates installed at the store exit.

European patent application EP 2 575 112 A1 discloses an inventory and anti-theft system using transponders (TAG) provided with RFID chips, which are interrogated in an ad hoc or continuous manner by an RFID reader, which transmits the data to a database. The transponder or tag comprises a coupling mechanism, which is opened at a point of sale. The chip records the number of times that the tag has been opened and closed. This information forms a part of the data transmitted. An unauthorised opening is thus detected. This system still requires the gates and the opening of the tag at the checkout by a special device. The product's movements within the store are not detected.

Anti-theft systems of the wired type are also known, which prevent a product installed on a display to be taken away from said display, using a wire between the product and the display. These systems are also capable of managing the presence of the products on the displays. However, these systems are bulky and often prevent the customer from trying the product.

SUMMARY OF THE INVENTION

The present invention aims to provide an anti-theft system that requires less expensive infrastructure and that allows the presence of the products to be managed, without the need for tags provided with locks or other bulky mechanisms.

This purpose is achieved by the system according to the accompanying claims. The invention relates to an anti-theft system that can be applied in a commercial environment such as a watch store. The products on display in-store are secured by an electronic tag attached to the product. The tag is provided with a chip which emits a first signal which can only be received within a defined perimeter around the chip. An electronic transmitting device is located within this perimeter, which sends the data transmitted within the first signal in the form of a second signal which further contains a value relative to the distance between the tag and the transmitting device. The second signal is managed by one or more computers, preferably of the portable type, which are equipped with a digital application configured to analyse the second signal and in particular to check for the presence of the tags within a defined security zone around the transmitting device.

Other features and advantages of the present invention will appear upon reading the following description given of preferred embodiments, provided as non-limiting examples with reference to the accompanying drawings.

DETAILED DESCRIPTION OF THE INVENTION

Figure 1:
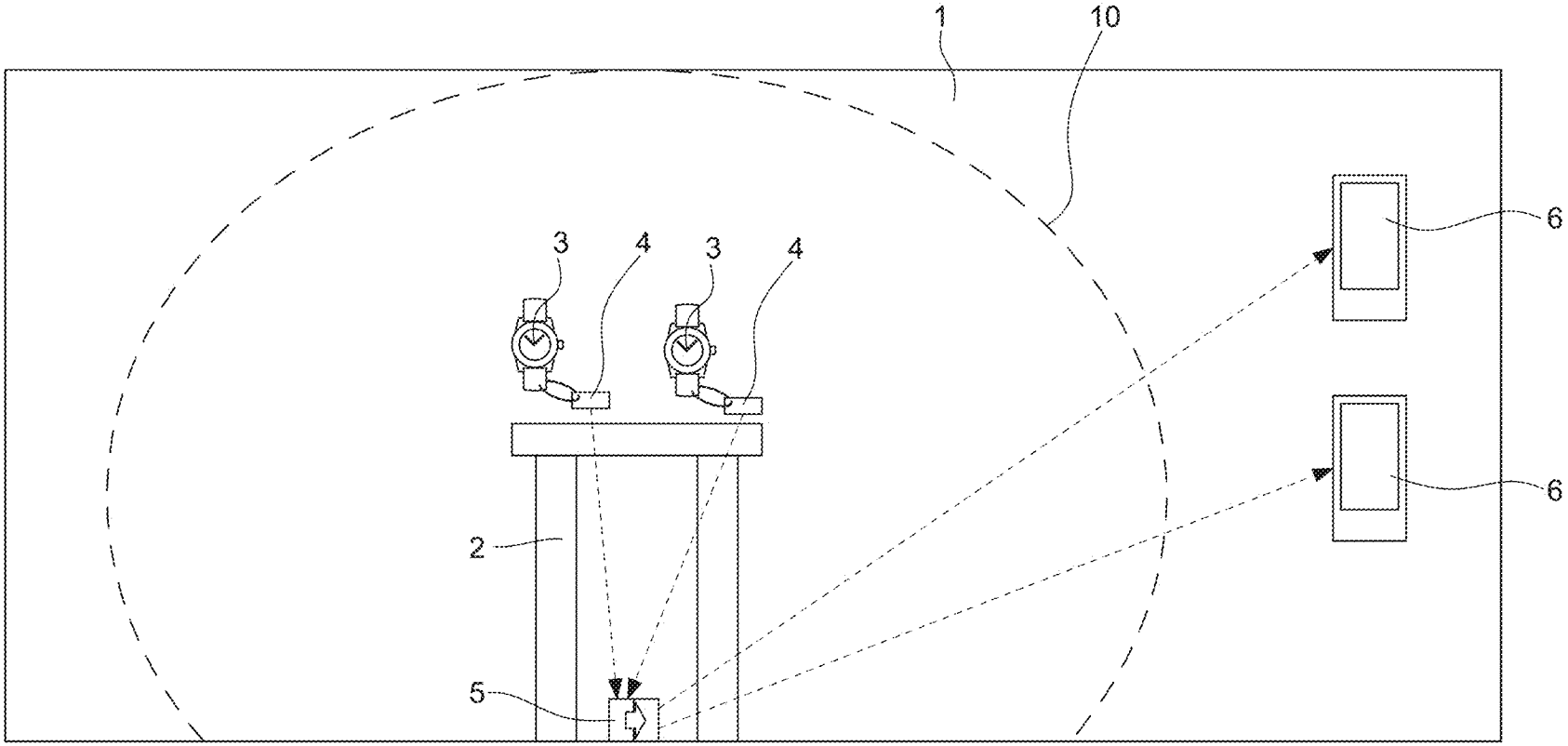
FIG. 1 diagrammatically shows an environment in which a security system according to the invention is integrated.

FIG. 1 shows a typical configuration of an anti-theft system according to the invention. The space within a watch store is shown as a rectangle 1. A table 2 is located inside the store, on which a plurality of watches 3 are on display. Electronic tags 4 are attached to the watches 3. Each tag (transponder) comprises a BLE (Bluetooth Low Energy) chip. BLE technology is known per se and allows the BLE chip to transmit data packets, referred to as advertising frames. A continuous sequence of these advertising frames represents the 'first signal' cited in the accompanying claims. In a manner characteristic of BLE technology, the first signal can only be received within a limited perimeter around the tags 4.

The advertising frames transmitted by the tags comprise a unique code for each watch 3 which allows the watches on display to be identified. In a fixed location relative to the table and within the perimeters of all the tags 4 when the watches 3 are positioned at designated locations on the table 2, an electronic transmitting device 5 (connection gateway of the 'BLE/WiFi gateway' type) is installed, which receives the advertising frames from the different tags 4. A connection gateway ("BLE/WiFi gateway") is well known per se and allows the information encoded in the advertising frames to be transmitted over a WiFi link. The connection gateway 5 used in the invention further transmits, for each tag, a so-called RSSI (Received Signal Strength Indication) value, which indicates the strength of the BLE signal received by the connection gateway 5.

According to one preferred application mode, one or more people affiliated with the store have a portable computer of the mobile phone or tablet 6 type, which continuously communicates with the BLE/WiFi gateway 5 over the WiFi link, and which thus receives the 'second signal' cited in the claims. The second signal is generated by a technology (WiFi) that is different from the technology (BLE) that generates the advertising frames. The second signal comprises at least the identification information encoded in the advertising frames by the different tags and the RSSI values.

A configurable security zone 10 is defined around the position of the connection gateway 5. The second signal is synchronised with the advertising frames sent by the set of tags within the security zone. The format of the second signal consists of the concatenation of the advertising frames of all tags within the zone 10 with, for each tag, all data sent as well as the RSSI value.

Each portable computer 6 is provided with a digital application, which checks, in real time, the RSSI values for the different tags 4, and which generates an alert when the RSSI of a tag 4 falls below a predefined threshold, indicating that the tag has been moved to outside the security zone 10. This indicates that the tag has been moved away from the zone 10 by an unauthorised person. The application will display information on the screen of the portable computer 6 in order to identify the tag in question and the product to which it is attached. This information is derived from the advertising frames transmitted by the tag 4.

Figure 2A:
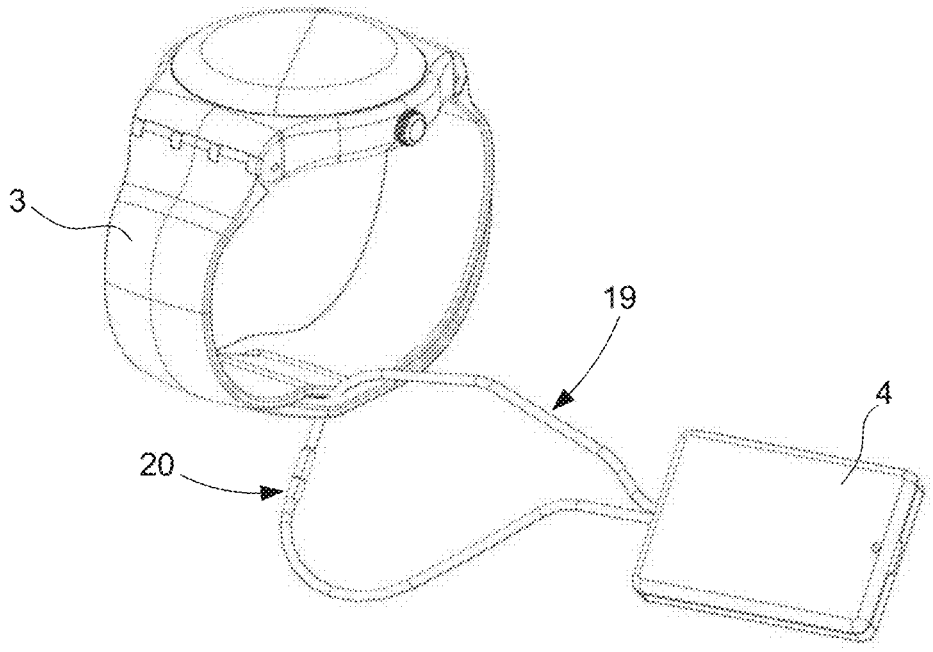
FIGS. 2*a* and 2*b* show an electronic tag (transponder) capable of being used in a security system according to the invention.
Figure 2B:
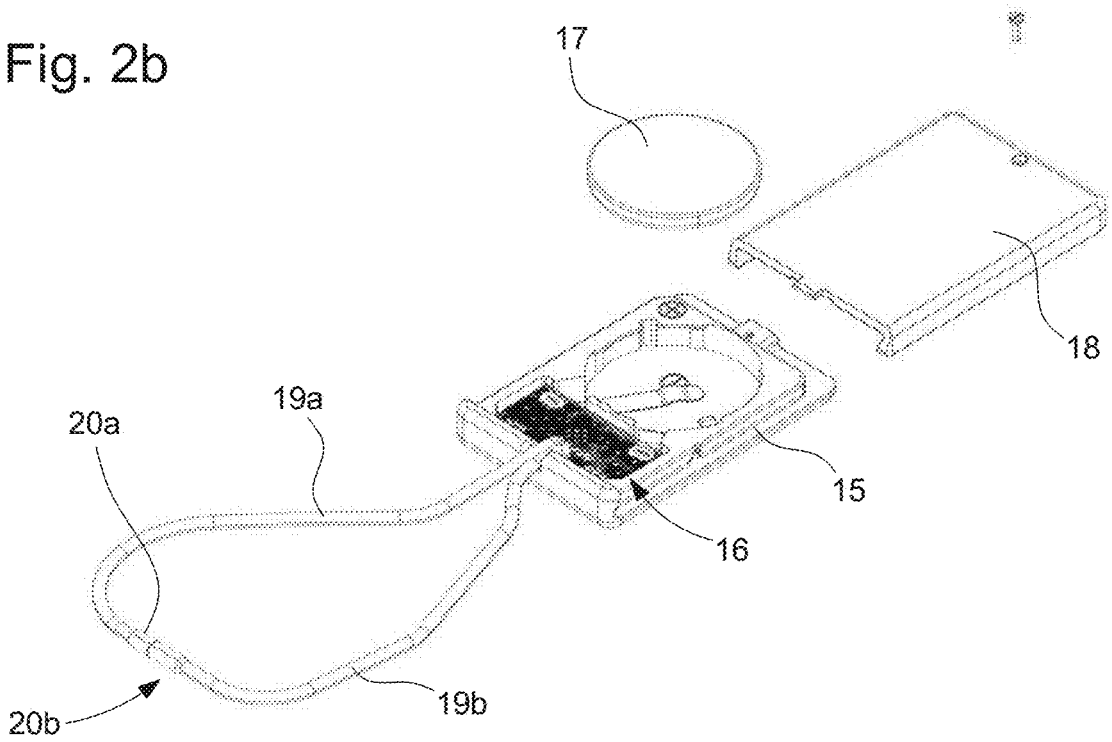

According to a preferred embodiment, the digital application is further configured so as to generate an alert when the connection between a tag 4 and the connection gateway 5 is lost. For this purpose, the tags 4 are attached to the watches 3 such that the separation of the tag 4 from the watch 3 by an unauthorised person will automatically deactivate the BLE chip inside the tag 4. A tag 4 of this type is shown in FIGS. 2*a* and 2*b*. The tag or transponder comprises a plastic case 15 in which are housed the BLE chip 16 and an energy source which can be a battery 17. A cover 18, for example made of plastic, is mounted in a removable manner on the case 15 and can include a label displaying the price of the product on display. The tag 4 is attached to the product by a loop 19, which comprises two strands 19*a* and 19*b* comprising or consisting of electric wires. The loop can be opened and closed by a bayonet or screwed connector 20, the two parts 20*a* and 20*b* whereof are fastened in a conducting manner to the ends of the two strands 19*a* and 19*b*.

According to a preferred embodiment, the loop is composed of synthetic fibres associated with electric wires giving the external appearance of a nylon thread ('E-Textile' type material). According to one embodiment, the loop forms an electrical connection which forms a part of the power supply circuit powering the chip 16 when the loop is closed. If an unauthorised person removes the tag, by cutting the loop 19 or by opening the connection 20, the BLE chip 16 stops transmitting advertising frames, which generates an alert on the portable computers 6. The alert message identifies the one or more specific watches based on the codes integrated into the advertising frames.

According to another embodiment, the closed loop 19 also forms a part of a circuit connected to the BLE chip 16, however without the opening of the loop cutting off the power supply to the chip. Nonetheless, this opening will be detected by the circuit, which triggers the transmission, by the chip, for a predefined period, for example several minutes, of advertising frames containing an alert message. This message will warn the users of the portable computers 6 that a tag has been removed in an unauthorised manner. After the predefined period, the BLE chip 16 can be deactivated.

According to one embodiment, the tags 4 are provided with an accelerometer, which generates a signal as a function of the movements of the tag 4 within the security zone 10, and the data relative to these movements is integrated into the advertising frames, and transmitted to the portable computers 6. The digital applications of the portable computers 6 are configured to interpret the movement data, and potentially to generate an alert in the case of unauthorised movements. This allows the products to be made secure on several levels, or the security levels to be adapted to suit the products. For example, a table of watches can be installed, which table must generate an alert as soon as a watch is moved from a display on which it is exhibited, and another table on which the watches can be handled by customers without triggering an alert, while transmitting the data relative to the movements. This data can be stored in the mobile phone or in a central computer, and be used as a basis for market studies for example.

The security system can comprise a plurality of connection gateways 5 associated with a plurality of groups of tags 4 inside a store, for example one connection gateway for each display table in a watch store. Distinct security zones 10 are thus allocated to the respective connection gateways 5. Each portable computer 6 can receive the information for all connection gateways 5 and thus for all tags 4 that are active in the store. Each portable computer receives the same information sent by the one or more gateways 5. According to a preferred embodiment, the digital application is configured such that each portable computer can filter in a different manner as a function of the user's needs. For example, a portable computer user can select a specific protection zone 10 or can choose to only display the information contained in the advertising frames, without the information regarding the displacement of the tags, or vice-versa.

Before a tag can be added to the system, a pairing procedure must be carried out between the tag and the one or more portable computers. The procedure generally consists of a communication between the tag and the portable computer, during which the portable computer receives the encoded information in the tag and registers the tag based on the identification data for the tag and the associated product. In the case of BLE tags, this pairing procedure is preferably carried out by producing a direct BLE link between the portable computer and the tag 4, i.e. a link that does not pass via the connection gateway 5. For this purpose, the BLE chip runs in 'connectable' mode during the pairing procedure. As soon as the pairing is complete, the chip switches to 'non-connectable' mode, which prevents any new connection and thus any new pairing. To return to 'connectable' mode, the tag must be restarted, for example by removing its battery.

Preferably, the first signal is encrypted to secure the communication between the tags and the portable computers. An encryption key can be communicated to the tags by one of the portable computers during the pairing procedure. By using this key, the portable computers are able to decrypt the data.

According to a preferred embodiment, the advertising frames are partially encrypted. The encrypted part in particular comprises a timestamp and other data. However, a part of the data is not encrypted, which allows it to be read without being paired. The encrypted data, which comprises a timestamp, can only be read by one or more portable devices or mobile phones that know the encryption key. This encryption prevents any unauthorised person from being able to read this information or encrypted data, such as alarms or errors or other data. Moreover, the addition of the timestamp in the encrypted part allows the data to be varied as a function of time and thus prevents an unauthorised person from cloning the tag.

A certain amount of information contained in the advertising frames is visible in an unencrypted form, such as the battery status for the tag for example, so as to be readable without being paired. However, other data must be encrypted, such as a timestamp and the alarms for example. The encrypted information of the advertising frame can only be read if the encryption key is known.

As indicated hereinabove, a timestamp is contained in the encrypted advertising frames. This can be a time value incremented every second. The timestamp allows the encrypted advertising frame to be changed entirely, which prevents the tags from being cloned. It is essentially impossible to predict the following frame without knowing the encryption key and the encryption algorithm. A frame which has stopped changing or which is erroneous, is considered to be a sabotage alarm.

What is claimed is:

1. An anti-theft system for securing products inside a defined space, the system comprising:

at least one tag provided with an electronic chip capable of transmitting a first signal in a repetitive manner and generated in a first technology, the signal only capable of being received within a limited perimeter around the tag, the tag being connected to a product on display by a disconnectable mechanical connection, the signal comprising information which allows the product to be identified, an electronic transmitting device, installed at a fixed position within said perimeter, the device being capable of receiving the first signal when the device is located within said perimeter, and of sending, in a repetitive manner, a second signal capable of being received outside the perimeter and generated in a second technology that is different from the first technology, the second signal comprising at least the information for identifying the product as well as a value related to the distance between the tag and the transmitting device, and at least one fixed or portable computer, configured such that it receives the second signal and provided with a digital application which is configured such that it manages, on the basis of said second signal, the presence of the tag within a defined security zone around the transmitting device, the fixed or portable computer further being configured such that it carries out a procedure for pairing the tag by producing a direct link according to the first technology with the tag without passing via the electronic transmitting device, when the electronic chip is operating in a so-called connectable mode.

2. The anti-theft system according to claim 1, wherein the digital application generates an alert when the tag is moved outside of the security zone.

3. The anti-theft system according to claim 1, further comprising a plurality of said electronic transmitting devices distributed within said space, such that distinct security zones are allocated to the devices, and wherein each device continuously communicates with one or more tags connected to the products on display in the respective zones, and wherein the one or more computers continuously communicate with each of the devices.

4. The anti-theft system according to claim 1, wherein the digital application and the disconnectable mechanical connection, which connects the tag to the product, are configured such that the removal of said connection or the unauthorised disconnection thereof generates an alert on the fixed or portable computer.

5. The anti-theft system according to claim 1, wherein the tag comprises:

a case that contains the chip and an electrical energy source for powering the chip, a power supply circuit for the chip, a loop that can be opened and closed for attaching the tag to a product, the loop comprising two parts comprising or consisting of electric wires, such that in a closed state, the loop forms a part of a circuit connected to the chip.

6. The anti-theft system according to claim 1, wherein:

at least one of the tags is configured such that it records data linked to the movements of the tag within the security zone, the tag is configured such that it sends said data in the first signal to the electronic transmitting device, the electronic transmitting device is configured such that it transmits said data to the computer in the second signal, the digital application is configured such that it records the data related to the movements of the tag, and optionally such that it generates an alert when unauthorised movements are recorded.

7. The anti-theft system according to claim 1, wherein the first signal is encrypted.

8. The anti-theft system according to claim 6, wherein the first signal is partially encrypted.

9. The anti-theft system according to claim 1, wherein the first signal is provided with a timestamp.

10. The anti-theft system according to claim 1, wherein the first technology is BLE (Bluetooth Low Energy) technology and wherein the first signal consists of a sequence of advertising frames in BLE format.

* * * * *